US006085814A

United States Patent [19]

Choe

[11] Patent Number: 6,085,814

[45] Date of Patent: Jul. 11, 2000

[54] HEAD COVER FOR GOLF CLUBS

[76] Inventor: Jin Tae Choe, San192, Sampeung Apt.22-1205, Seocho-Dong, Seocho-Ku, 137-070, Seoul, Rep. of Korea

[21] Appl. No.: 09/233,213

[22] Filed: Jan. 20, 1999

[30] Foreign Application Priority Data

Nov. 7, 1998 [KR] Rep. of Korea ..... 98-47648

[51] Int. Cl.[7] ..... A63B 57/00; B65D 65/02

[52] U.S. Cl. ..... 150/160; 206/315.2

[58] Field of Search ..... 150/160, 159; 206/315.4, 315.2

[56] References Cited

U.S. PATENT DOCUMENTS

| | | | |
|---|---|---|---|
| 2,526,985 | 10/1950 | Whitehead | 150/160 |
| 2,532,195 | 11/1950 | Rosenow et al. | 150/160 |
| 2,737,394 | 3/1956 | Abel | 150/160 X |
| 3,548,908 | 12/1970 | Koetting | 159/160 |
| 3,727,659 | 4/1973 | Shuford | 159/160 |
| 3,831,652 | 8/1974 | Hyden et al. | 150/160 |
| 3,938,570 | 2/1976 | Stewart | 150/160 |
| 4,368,768 | 1/1983 | Cunko, Jr. | 150/160 |
| 5,769,141 | 6/1998 | Rinehard | 150/160 |

*Primary Examiner*—Sue A. Weaver
*Attorney, Agent, or Firm*—McDermott, Will & Emery

[57] ABSTRACT

A head cover for golf clubs is disclosed. In the head cover, a main shaping member has a shape corresponding to a part of the appearance of a club head. An elastic covering member is integrated with the edge of the main shaping member, thus forming a head protection sock with an expansible space. The covering member is expansible to receive the club head within the space regardless of the size of the club head. An elongated guide sleeve extends from the elastic covering member to a length, thus having an elongated part ended at a mouth and used for guiding the club head into the head protection sock. The above guide sleeve is designed to be closely creased at the elongated part closer to the mouth and at the inside edge portion thereof closer to the elastic covering member with a junction between the elongated part and the inside edge portion being sparsely creased. An elastic band is set at the junction between the elastic covering member and the elongated guide sleeve, thus allowing the space of the head protection sock to be expansible in order to effectively keep any club head.

6 Claims, 5 Drawing Sheets

HEAD COVER FOR GOLF CLUBS

BACKGROUND OF THE INVENTION

1. Field of the Invention

The present invention relates, in general, to head covers for golf clubs and, more particularly, to a head cover capable of allowing a large number of golf clubs to be received in a golf bag at the same time.

2. Description of the Prior Art

As well known to those skilled in the art, golf clubs are typically classified into two types; wood clubs having wood heads and iron clubs having metal heads. The configurations and constructions of typical wood and iron clubs are similar to each other as follows. As shown in FIG. 1, a typical wood club comprises a hemispherical head 1 which directly hits a golf ball. A shaft 2 linearly extends from the head 1 to a length and supports a centrifugal force generated on the head 1 during a swing action of the club. The shaft 2 is made of a tube having a circular cross-section, while the length of the shaft 2 is so determined as to generate an appropriate centrifugal force on the head 1, thus allowing the head 1 to strongly hit a golf ball. In order to integrate the head 1 with the shaft 2, a shaft hole (not shown) is formed on the head. The shaft hole of the head 1 has a predetermined depth suitable for receiving one end of the shaft 2. Provided on the other or free end of the shaft 2 is a grip 3 which is gripped by the hands of a golfer.

When carrying the wood and iron golf clubs on a green or other areas, a golfer takes a golf bag with the golf clubs being received in said bag. In such a case, the golf clubs are arranged within the golf bag with the heads of the clubs being positioned at the top of the bag. Therefore, the heads of the golf clubs may undesirably strike on each other, thus being damaged. Particularly, when the wood clubs, having similar lengths, repeatedly strike on each other at their heads 1, thus being repeatedly impacted, the heads 1 of the wood clubs are somewhat seriously damaged. In an effort to protect the club heads 1 from being so damaged due to collision, it is preferable to use head covers.

A typical head cover 5 is shown in FIG. 2 As shown in the drawing, the typical head cover 5 comprises a head protection sock 6' provided with an elongated guide sleeve 7'. The head protection sock 6' is made of a thick, elastic material capable of effectively covering and protecting the club head 1 from external impact. The above guide sleeve 7' is designed to effectively retain the club head 1 within the head protection sock 6', thus almost completely preventing the club head 1 from being unexpectedly removed from said sock 6'.

However, such typical head covers 5 are problematic in that, since the head protection sock 6' is made of a thick, elastic material, the volume of the sock 6' is so large as to regrettably prevent a large number of golf clubs from being received in a golf bag. Another problem experienced in the typical head covers 5 resides in that the covers are differently sized in order to meet the different sizes of club heads, thus needing to be classified by numerical sizes one by one.

SUMMARY OF THE INVENTION

Accordingly, the present invention has been made keeping in mind the above problems occurring in the prior art, and an object of the present invention is to provide a head cover for golf clubs, which effectively protects a club head, allows a large number of golf clubs to be received in a golf bag at the same time, and is freely used for covering any club head regardless of the size of said club head.

In order to accomplish the above object, the present invention provides a head cover for golf clubs, comprising: a main shaping member designed to have a shape corresponding to a part of the appearance of a club head and maintaining said shape; and an elastic covering member integrated with the edge of the main shaping member, thus forming a head protection sock with an expansible space, said covering member being expansible to receive the club head within the space regardless of a size of said club head.

The above head cover may further comprise an elongated guide sleeve, which extends from the elastic covering member to a length and is used for guiding the club head into the head protection sock. The guide sleeve is also creased along an axis thereof, thus having at least one elongated elastic seam.

An elastic band is preferably set at the junction between the elastic covering member and the elongated guide sleeve, thus allowing the space of the head protection sock to be expansible in order to effectively keep the club head within the pace of the head protection sock.

The elongated guide sleeve is designed to be closely creased at an outside portion closer to the mouth thereof and at an inside portion thereof closer to the elastic covering member with a junction between the two portions being sparsely creased.

The main shaping member is made of a soft or hard material and is provided with an additional shaping member at the edge thereof. The additional shaping member allows the main shaping member to more securely maintain its originally designed shape.

The above additional shaping member is made of a soft or hard material and has a circular cross-section.

The external surface of the main shaping member may be covered with a soft fabric.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
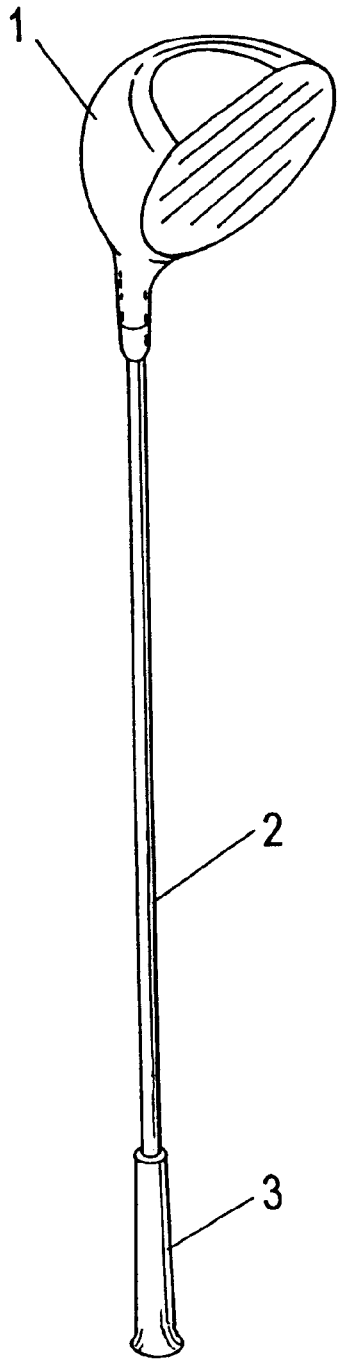
FIG. 1 (PRIOR ART)
FIG. 1 is a perspective view of a typical wood club.
Figure 2:
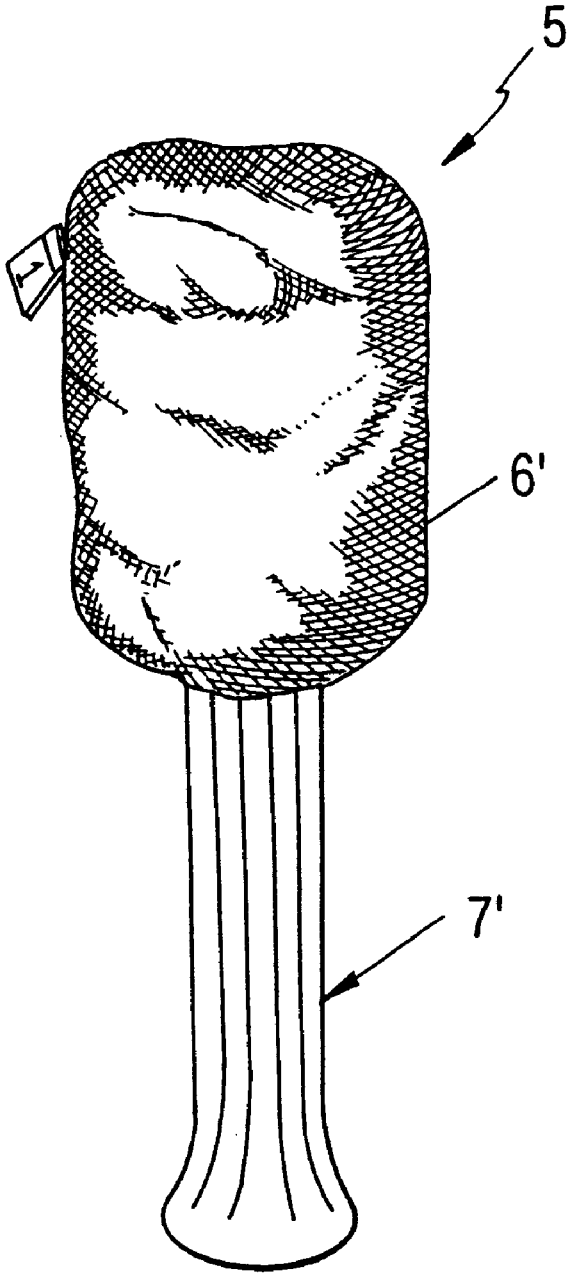
FIG. 2 (PRIOR ART)
FIG. 2 is a perspective view of a typical head cover for golf clubs.
Figure 3:
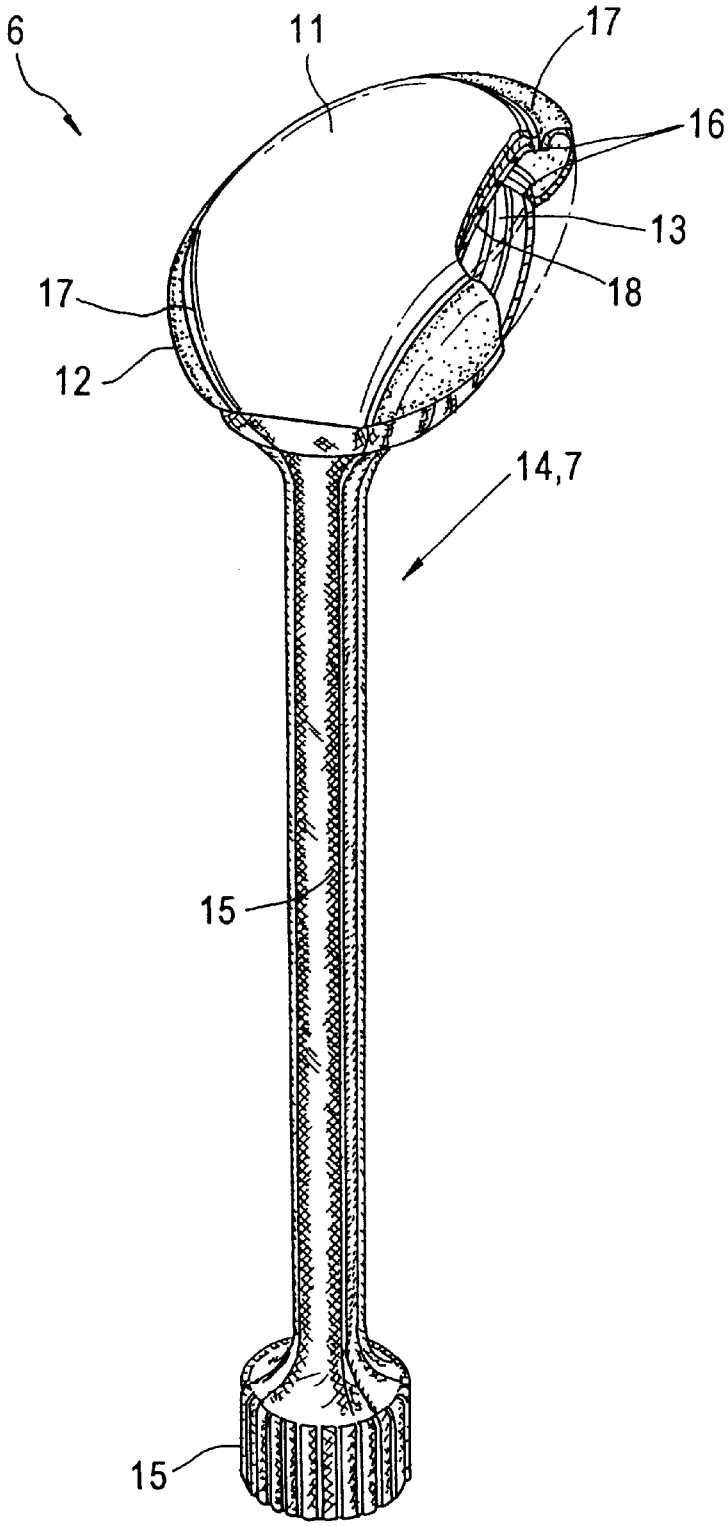
FIG. 3 is a partially broken perspective view of a head cover for golf clubs in accordance with the primary embodiment of the present invention.
Figure 4:
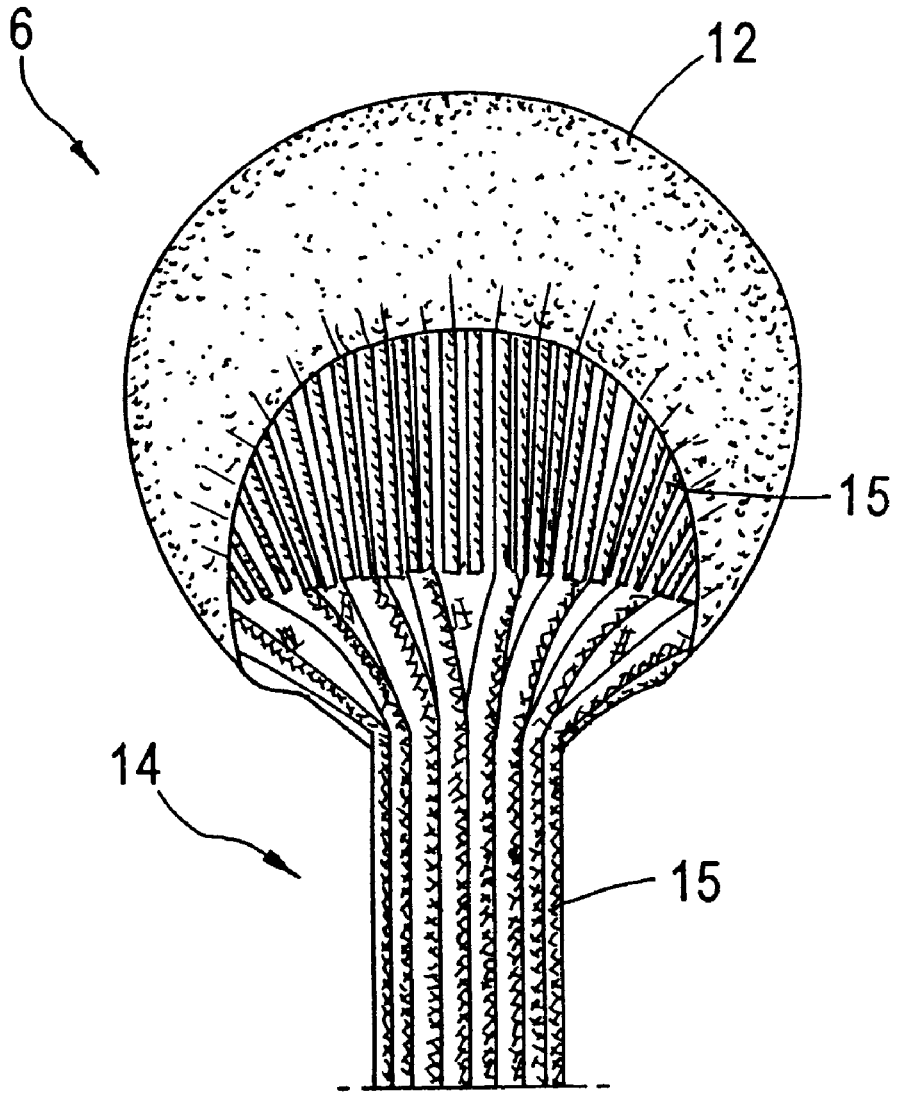
FIG. 4 is a rear view of the head cover of this invention.
Figure 5:
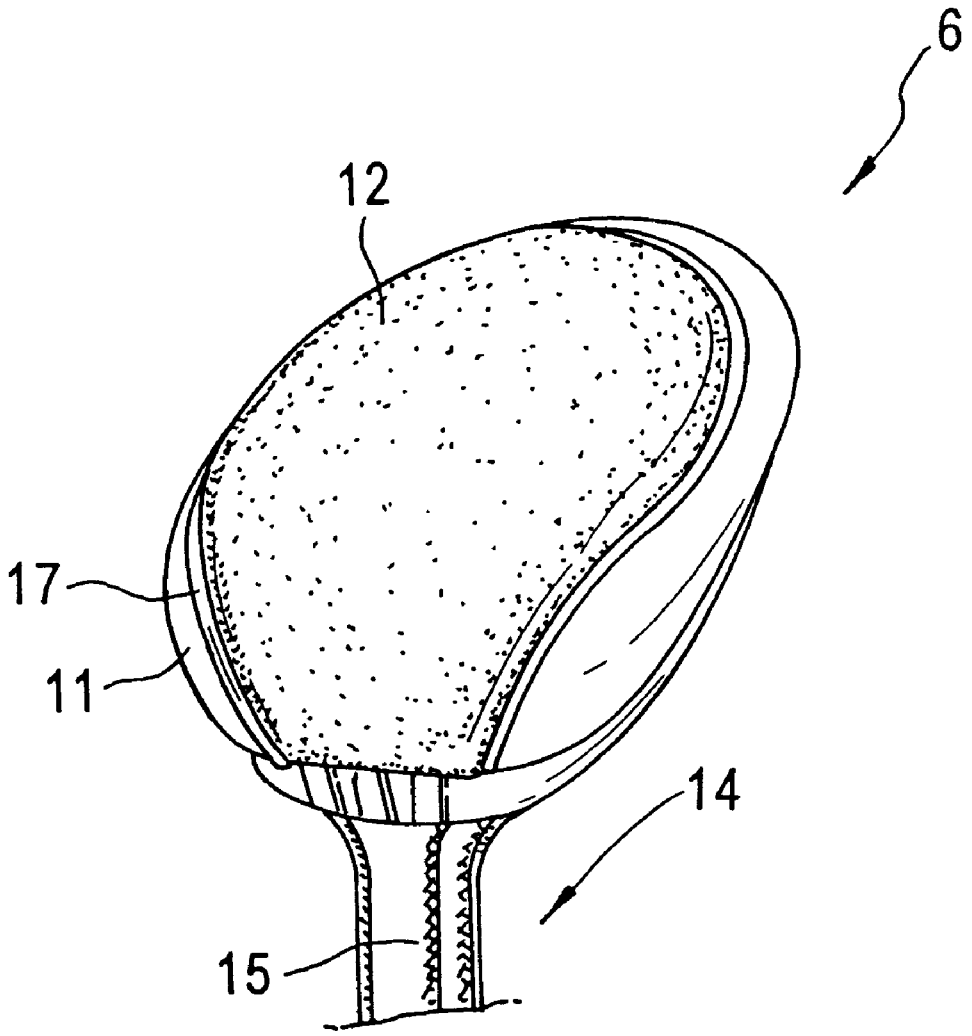
FIG. 5 is a perspective view of a head cover for golf clubs in accordance with another embodiment of the present invention.

FIG. 3 is a partially broken perspective view of a head cover for golf clubs in accordance with the primary embodiment of this invention. FIG. 4 is a rear view of the above head cover. FIG. 5 is a perspective view of a head cover for golf clubs in accordance with the second embodiment of this invention.

As shown in FIG. 3, the head cover of this invention comprises a head protection sock 6 provided with an elongated guide sleeve 7 at its inlet. The head protection sock 6 is provided with a main shaping member 11 at the top. The main shaping member 11 is for retaining a desired shape of the sock 6, with the shape of said sock 6 being so designed as to meet the uniquely designed appearance of a club head 1. An elastic covering member 12 is integrated with the rounded edge of the above shaping member 11, thus forming a sock 6 having a space 13 for a club head 1. The above space 13 is defined by both the main shaping member 11 and the elastic covering member 12. The elongated guide sleeve 7 extends from the elastic covering member 12 to a length, thus having an elongated part 14, which is ended at a mouth and is used for guiding a club head 1 into the space 13 of the head protection sock 6. The above guide sleeve 7 is creased along the axis thereof, thus having a plurality of elongated, parallel elastic seams 15. The elastic covering member 12 is preferably made of an elastic, expansible cloth, such as velvet.

In order to almost completely prevent a club head 1 from being unexpectedly removed from the space 13 of the sock 6, an elastic band 16 is integrally set at the junction between the elastic covering member 12 of the sock 6 and the closely creased inside end of the guide sleeve 7. The above band 16 gives an important functional effect or a target of this invention to the head cover. That is, the band 16 has an appropriate elasticity capable of allowing the space 13 to be somewhat freely expansible in order to effectively receive any club head 1 regardless of the size of said head 1.

In the present invention, the main shaping member 11 may be made of a soft or hard plastic material. Alternatively, the shaping member 11 may be made of a natural cloth which yields the same operational function as that expected from the above-mentioned soft or hard plastic material. In the case of a shaping member 11 made of a hard plastic material, the member 11 has a hard surface. On the other hand, a shaping member 11 made of a soft plastic material has a restoring force capable of restoring its original shape after being deformed. An additional shaping member 17, along with the elastic covering member 12, is integrated with the edge of the main shaping member 11, thus allowing the main shaping member 11 to more securely maintain its originally designed shape. The above additional shaping member 17 is preferably made of a material similar to that of the main shaping member 11 and has a circular cross-section.

Both the main shaping member 11 and the elastic covering member 12 are lined with a soft cotton fabric 18, which comes into contact with a club head 1 and protects the surface of said club head 1. The integration of the main shaping member 11, the elastic covering member 12, the elongated guide sleeve 7 and the additional shaping member 17 is accomplished by a sewing process. When the main shaping member 11 is made of a soft plastic material, a hard, thin plate may be interposed between the main shaping member 11 and the soft cotton fabric 18, thus retaining a desired shape of the main shaping member 11.

As best seen in FIG. 4, the number of elongated, parallel elastic seams 15, formed on the guide sleeve 7, varies in accordance with the positions of said sleeve 7 in a way such that the sleeve 7 is more closely creased at the narrow, elongated part 14 closer to the mouth and at the inside edge where the sleeve 7 is integrated with the elastic covering member 12. That is, the number of elongated, parallel elastic seams 15 is remarkably increased at both the elongated part 14 and the inside edge of the sleeve 7, but is reduced at the junction between said elongated part 14 and said inside edge. The closely creased, elongated part 14 of the sleeve 7 is thus highly expansible, and so the club head 1 smoothly passes through the elongated part 14 when it is necessary to receive or remove the club head 1 relative to the head protection sock 6. Similarly, the closely creased inside edge of the elongated guide sleeve 7 allows the club head 1 to smoothly pass through when the club head 1 is received into or removed from the space 13 of the sock 6. However, the expansibility of the sparsely creased junction between the above-mentioned closely creased portions is remarkably less than that of the closely creased portions, and so the junction does not allow the club head 1 to smoothly pass through. Therefore, it is necessary for the club head 1 to be forced by a user when it passes through the sparsely creased junction and this almost completely prevents the head cover from being unexpectedly removed from the club head 1.

In the second embodiment of FIG. 5, an elastic covering member 12, having a shape corresponding to a uniquely designed shape of the club head 1, is positioned at the top of the head sock 6, while a main shaping member 11, made of a plastic material, is integrated with the rounded edge of the above elastic covering member 12, thus forming a sock 6 having a space for the club head 1. In a brief description, the positions of the two members 11 and 12 according to the second embodiment are reversed to those of the primary embodiment. In this second embodiment, an additional shaping member 17 is set at the junction between the two members 11 and 12. The head cover according to the second embodiment yields the same operational effect as that of the primary embodiment and further explanation for the operational effect is thus not deemed necessary.

In accordance with a further embodiment of this invention, the external surface of said main shaping member 11 may be completely covered with a soft fabric, thus improving the appearance of the head cover.

As described above, the present invention provides a head cover for golf clubs. The head cover of this invention has an expansible space capable of somewhat freely receiving any club head regardless of the size of the club head. In the head cover of this invention, a shaping member retains a desired shape of the head cover, while an elastic covering member, integrated with the edge of the shaping member into a head cover, allows the head cover to freely receive any club head regardless of the size of the club head since the covering member has an appropriate expansibility. In addition, the above head cover has a high elasticity and so it somewhat tightly covers the club head without being enlarged in volume. The head cover of this invention thus allows a large number of golf clubs to be received in one golf bag with the club heads being effectively protected from damage. The above head cover is thus convenient to users.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A head cover for golf clubs, comprising:

a main shaping member designed to have a shape corresponding to a part of the appearance of a club head and maintaining said shape;

an elastic covering member integrated with the edge of said main shaping member, thus forming a head protection sock with an expansible space, said covering member being expansible to receive the club head within said space regardless of a size of said club head; and an elastic band set at a junction between said elastic covering member and an elongated guide sleeve, for allowing the space of the head protection sock to be expansible in order to effectively keep the club head.

2. The head cover according to claim 1, wherein said elongated guide sleeve extends from said elastic covering member to a length, thus having an elongated part ended at a mouth and used for guiding the club head into the head protection sock, said guide sleeve being creased along an axis thereof, thus having at least one elongated, elastic seam.

3. The head cover according to claim 1, wherein said main shaping member is made from one of a soft and a hard material and is provided with an additional shaping member at an edge thereof, said additional shaping member allowing the main shaping member to more securely maintain its originally designed shape.

4. The head cover according to claim 3, wherein said additional shaping member is made from one of a soft and hard material and has a circular cross-section.

5. The head cover according to claim 3, wherein an external surface of said main shaping member is covered with a soft fabric.

6. A head cover for golf clubs, comprising:

a main shaping member designed to have a shape corresponding to a part of the appearance of a club head and maintaining said shape;

an elastic covering member integrated with the edge of said main shaping member, thus forming ahead protection sock with an expansible space, said covering member being expansible to receive the club head within said space regardless of a size of said club head; and an elastic band, set at a junction between said elastic covering member and said elongated guide sleeve, for allowing the space of the head protection sock to be expansible in order to effectively keep the club head;

an elongated guide sleeve extending from said elastic covering member to a length, thus having an elongated part ended at a mouth and used for guiding the club head into the head protection sock, said guide sleeve being creased along an axis thereof, thus having at least one elongated, elastic seam; and wherein said elongated guide sleeve is closely creased at the elongated part closer to the mouth and at an inside edge portion thereof closer to the elastic covering member with a junction between said elongated part and said inside edge portion being sparsely creased.

* * * * *